United States Patent [19]

Gullotti et al.

[11] 4,066,480

[45] Jan. 3, 1978

[54] PROCESS FOR IMPROVING THE HOT WORKABILITY OF ALUMINUM-MAGNESIUM ALLOYS

[75] Inventors: Damian V. Gullotti, Cheshire, Conn.; William S. Fayard, Biloxi; Wiley W. Wedgeworth, Gulfport, both of Miss.

[73] Assignee: Swiss Aluminium Ltd., Chippis, Switzerland

[21] Appl. No.: 713,524

[22] Filed: Aug. 11, 1976

[51] Int. Cl.[2] ..... C22F 1/04

[52] U.S. Cl. ..... 148/11.5 A; 148/12.7 A; 148/159

[58] Field of Search ..... 148/11.5 A, 12.7 A, 148/159

[56] References Cited

U.S. PATENT DOCUMENTS

| | | | |
|---|---|---|---|
| 3,346,371 | 10/1977 | Jagaciak | 148/11.5 A |
| 3,346,372 | 10/1977 | Jagaciak | 148/11.5 A |
| 3,346,377 | 10/1977 | Jagaciak | 148/11.5 A |
| 3,379,583 | 4/1968 | Gruhl et al. | 148/11.5 A |
| 3,392,062 | 7/1968 | Altenpohl et al. | 148/11.5 A |
| 3,418,177 | 12/1968 | Pryor | 148/11.5 A |
| 3,762,962 | 10/1973 | Nilsson | 148/12.7 A |
| 3,816,190 | 6/1974 | Warbichler et al. | 148/11.5 A |
| 3,990,922 | 11/1976 | Gullotti et al. | 148/11.5 A |

*Primary Examiner*—W. Stallard

*Attorney, Agent, or Firm*—Robert A. Dawson; Robert H. Bachman

[57] ABSTRACT

A method of heat treating aluminum alloys of the aluminum-magnesium type to improve the hot workability of the alloys which consists essentially of homogenizing the alloys at a temperature from 950° to 1050° F for from 2 to 12 hours and slowly cooling said alloys to at least 800° F at a rate of less than 100° F per hour.

10 Claims, No Drawings

PROCESS FOR IMPROVING THE HOT WORKABILITY OF ALUMINUM-MAGNESIUM ALLOYS

BACKGROUND OF THE INVENTION

The present invention relates to heat treating aluminum base alloys prior to hot working operations. The invention is particularly concerned with a homogenization heat treatment of the aluminum base alloys prior to extrusion.

The metal working process known as extrusion involves pressing metal stock through a die opening having a predetermined configuration in order to form a shape having indefinite length and a substantially constant cross section. In the direct extrusion process with which this invention is particularly concerned, the aluminum base alloy stock is preheated and placed in a cylinder which is also usually heated. The heat treatment process of the present invention may also be utilized prior to indirect extrusion processes. The cylinder utilized in the direct extrusion process has a suitable die at one end and a reciprocable piston or ram having approximately the same cross sectional dimensions as the bore of the cylinder. This piston or ram moves against the stock to compress the stock and cause the metal to flow through the die opening. The pressure exerted on the stock during this operation raises the internal temperature of the stock as a result of redundant work within the metal stock body.

The present invention is particularly concerned with aluminum base alloys of the aluminum-magnesium type. Extruded profiles of aluminum-magnesium alloys have considerable commercial value. Such alloys find diversified use as structural materials because of their very high strength to weight properties. In order to produce extruded articles from such alloys in the most economical manner, the extrusion process should be carried out at the highest extrusion speed possible for the apparatus being used. The aluminum-magnesium alloys have been found difficult to hot work in commercial production. These difficulties have been manifest as pronounced edge cracking, alligatoring or surface cracking during hot working, or as pronounced surface cracking or break up of the extruded material during the extrusion process.

Extrusion speed and temperature are factors which affect the quality of aluminum-magnesium alloys as extruded products. In order to achieve acceptable surface quality in the extruded products, a certain limited range of extrusion speeds and temperatures must be closely observed with the range being related to the size of the extrusion and the reduction in cross sectional area of the metal stock during the extrusion process. Exceeding the predetermined speed and temperature ranges generally causes a rupture of the extrusion surface as indicated above and also other defects which result in rejection of the extruded product.

A limiting factor for extrusion of an aluminum alloy is the onset at some extrusion speed of the phenomenon known as surface checking or chatter cracks. These are surface defects which form a pattern of fine transverse cracks resulting from longitudinal tensile stresses which are high compared with the strength of the alloy at its working temperature. The incipient cracks may be no deeper than 0.001 to 0.005 inch but they are unacceptable from the standpoints of surface appearance, finishing ability, dimensional accuracy and mechanical integrity of the extruded product. It is known that this surface checking or chatter cracking phenomenon occurs at lower speeds as the extrusion temperature is increased. It is also known that high strength alloys must be extruded more slowly and at lower temperatures than lower strength alloys in order to avoid cracking of the high strength alloys. This suggests that there is an interaction between the flow and fracture mechanisms during hot working of the alloys. There is also a direct relationship between the hot ductility and the extrudability of the alloys.

SUMMARY OF THE INVENTION

The present invention comprises a method of heat treating aluminum base alloys of the aluminum-magnesium type in order to improve the hot workability of the alloys, preferably by extrusion. The method comprises:

a. homogenizing said alloys at a temperature from 950° to 1050° F (510° to 565.5° C) for from 2 to 12 hours; and optionally b. slowly cooling said alloys to below 800° F (426.7° C) at a rate of less than 100° F (37.8° C) per hour.

Following the cooling step, the alloys are cooled to room temperature and reheated to an elevated temperature for extrusion at said elevated temperature. Preferably, the extruded product is then cooled and later stretched to impart additional strength by cold working thereof.

Accordingly, it is a principal object of the present invention to provide a method of heat treating aluminum base alloys of the aluminum-magnesium type to improve the hot workability of said alloys, particularly by extrusion.

It is a particular object of the present invention to provide a method as aforesaid which enables an increase in the extrusion speed of said alloys.

It is a further object of the present invention to provide a method as aforesaid which results in an extruded product having good mechanical properties and freedom from surface cracks.

Further objects and advantages of the present invention will appear from a consideration of the following detailed description.

DETAILED DESCRIPTION

Preferably, the alloys processed in accordance with the present invention are those of the 5000 series of The Aluminum Association classification system, of which Alloy 5086 is preferred. For example, a typical preferred composition for Alloy 5086 is as follows:

Silicon — up to 0.40%
Iron — up to 0.50%
Copper — up to 0.10%
Manganese — 0.20 to 0.70%
Magnesium — 3.50 to 4.50%
Chromium — 0.05 to 0.25%
Zinc — up to 0.25%
Titanium — up to 0.15%
Others Total — up to 0.15%
Others Each — up to 0.05%
Aluminum — Balance Further preferred materials which may be processed in accordance with the present invention may include Alloy 5456 among others in the 5000 series. Amounts as low as 0.001% by weight may be utilized for each of the alloys below the certain percentages indicated above.

Hot workability, in general, may be improved by homogenization. Therefore, the first function of a homogenization treatment prior to extrusion is to minimize chemical gradients and microsegregation of alloy constituents in the ingot which result from casting. The second function of the homogenization treatment is to place the alloy in a condition in which it can be more readily worked. The ease of working is a result of increasing the hot ductility of the alloy by precipitation and coarsening of the manganese and chromium rich phases of the alloy by means of the high temperature homogenization treatment. Other minor alloying elements which may also be precipitated include those which are normally slow to precipitate, such as iron, titanium and others described above.

It has been found in accordance with the present invention that bulk hot ductility can be increased by creating the minimum degree of both solid solution hardening and dispersion hardening of the alloy at the extrusion temperature. This has been obtained in a homogenized microstructure by precipitation of as much chromium and manganese as possible out of the solid solution in the alloy. The present invention utilizes a high temperature homogenization to coarsen the chromium and manganese alloying additions in the system. The optional slow cooling is utilized to reprecipitate any phases which were in solid solution in the alloy at the high temperature operation. This slow cooling also serves to assist the ripening of the chromium and manganese phases in particular.

High temperature ductility is the limiting factor controlling the hot workability of the preferred alloy system utilized in the present invention. This ductility is dictated by the interaction of the softening mechanisms operating in the alloy during hot working along with the fracture mechanism of the alloy. The operative softening mechanism for the alloys preferred in the process of the present invention is repolygonization or a continuous break up and reformation of subgrains in the alloy system. The ability of the alloys to soften upon working is altered by differences in the disposition of manganese and chromium transition element phases added to the 5000 series alloys preferred in the present invention for strength and corrosion resistance. When these phases are rendered coarser by the high temperature homogenization of the present invention, softening of the alloy is facilitated.

The ingots themselves may be produced by any of the well known casting processes, the continuous or semi-continuous method being one of the most commonly used at the present time in industry. The processing of the present invention was devised in order to achieve the foregoing objectives using a high temperature homogenization cycle prior to extrusion. In accordance with the present invention, the homogenization treatment is at a temperature of from 950° to 1050° F (510° to 565.5° C), preferably from 975° to 1050° F (524° to 565.5° C), for from 2 to 12 hours, preferably from 5 to 10 hours. The process of the present invention is particularly appropriate for alloys such as Alloy 5086 which have deliberate additions of chromium, manganese and other transition elements with limited solubility so that the homogenization treatment of the present invention drives these additions out of the solution. Following the homogenization step, the alloys are cooled to room temperature at any desired rate. This cooling to room temperature is preferably air cooling. The alloys may be optionally cooled following homogenization to at least 800° F (426.7° C) at a rate of less than 100° F (37.8° C) per hour, preferably at a rate of less than 70° F (21.1° C) per hour. This optional slow cooling is followed by cooling of the alloys to room temperature at any desired rate. This cooling to room temperature is also preferably air cooling.

The homogenization treatment serves to precipitate from solid solution the normally slow diffusing phases such as the iron, chromium and manganese phases. This would tend to lower the matrix strength by removing these elements from any active hardening role by causing precipitate particles to become relatively large.

After cooling the homogenized alloy to substantially room temperature, the material is reheated to an elevated temperature and extruded at said elevated temperature. Normally, the material is reheated to a temperature of 800° to 1025° F (426.7° to 550° C), with an extrusion entry temperature of from about 650° to 950° F (343.3° to 510° C), preferably 700° to 900° F (371.1° to 482.2° C) and an extrusion exit temperature of from about 870° to 1020° F (465.5° to 548.9° C). The optimum entry temperature should be about 740° to 860° F (393.3° to 460° C). The time at reheat or preheat temperature prior to extrusion is not significant. The precipitated chromium an manganese rich phases in the alloy result in a more readily workable material which offers lower resistance to deformation during extrusion and allows the attainment of higher extrusion speeds.

Following extrusion, the extruded product is cooled and stretched. The cooling medium may naturally be moving air, complete water immersion, water sprays or combinations thereof.

Therefore, in accordance with the process of the present invention a careful control of processing conditions is required in order to increase the available ductility of the metal so as to subsequently increase the rate at which extrusions can be pushed through the extrusion die. The high temperature homogenization is important in assisting in the precipitation of elements such as manganese, chromium and iron. This homogenization treatment thus minimizes a potential dispersion hardening effect. Slow cooling to 800° F (426.7° C) or below causes the precipitate particles to further grow.

The present invention and improvements therefrom will become more apparent from a consideration of the following illustrative examples.

EXAMPLE I

Aluminum Alloy 5086 was cast in a conventional manner to have the following composition:

Magnesium — 3.78%
Silicon — 0.16%
Chromium — 0.17%
Manganese — 0.48%
Iron — 0.22%
Titanium — 0.014%
Zinc — 0.01%
Copper — 0.025%
Aluminum — Balance Billets having dimensions of 33 inches in length and 9 inches in diameter were made from the cast alloy. The billets were divided into four equal groups and homogenized as follows:

A. Standard homogenization: 10 hours/875° F, air cool;
B. Simplex high temperature homogenization: 5 hours/1000° F, air cool;

C. Simplex high temperature homogenization: 5 hours/1000° F, cool 50° F/hour to 800° F, air cool;

D. Simplex high temperature homogenization: 5 hours/1050° F, air cool.

The homogenizations were performed in a furnace capable of ±10° F temperature control. Thermocouples were peened into drilled holes in the billets at the top and bottom locations thereof and the metal temperatures thus obtained were used to determine metal soaking times and cooling rates. The torsional ductility of each group of specimens was determined by applying a constant strain rate to each group and measuring the shear strain at the failure of each sample. The results are shown in Table I.

TABLE I

TORSIONAL DUCTILITY AT 825° F FOR BILLET SAMPLES

| Homogenization | Strain Rate sec. $^{-1}$ | Shear Strain to Failure |
|---|---|---|
| Standard | 0.23 | 6.8 |
| 5 hrs./1000° F,ac | 0.23 | 10.9 |
| 5 hrs./1000° F, cool 50° F/hr. to 800° F, ac | 0.23 | 12.9 |
| 5 hrs./1050° F, ac | 0.23 | 13.1 |

The data presented in Table I indicate that the simplex high temperature homogenization treatment enhances the torsional ductility of the alloy relative to the standard homogenization treatment.

The cooling rate has only a modest influence on the torsional ductility. By inference, the extrudability of the alloys should be approximately as good for the air cooled (ac) samples as for the slowly cooled samples.

EXAMPLE II

The billets of Example I (standard; simplex 5 hours/1050° F, cool 50° F/hour to 800° F, ac), were reheated before being extruded. Each billet was heated so that the entry temperature in the extrusion apparatus was from 775 to 940° F. The billet container temperature was set at 750° F. The extrusion ratio for each billet was 22:1. Each billet was extruded and the highest speed attainable before cracking of the extrusion was measured for the billets of the standard and simplex homogenization treatments. The results are shown in Table II.

TABLE II

EXTRUSION RESULTS FOR STANDARD AND SIMPLEX HOMOGENIZED BILLETS

| Homogenization | Entry Temp. ° F | Speed at Cracking Onset, fpm |
|---|---|---|
| Standard | 810 | 34 |
| | 840 | 22 |
| | 865 | 18 |
| | 875 | 20 |
| | 880 | 34 |
| | 940 | 20 |
| Simplex | 775 | 50 |
| | 795 | 30 |
| | 825 | 28 |
| | 860 | 30 |

TABLE II-continued

EXTRUSION RESULTS FOR STANDARD AND SIMPLEX HOMOGENIZED BILLETS

| Homogenization | Entry Temp. ° F | Speed at Cracking Onset, fpm |
|---|---|---|
| | 870 | 50 |
| | 875 | 25 |

The data presented in Table II indicate that the maximum speed for the standard homogenized material was 34 fpm. The maximum speed for the simplex high temperature homogenized material was 50 fpm. These maximum extrusion speeds are related to commercial production speeds by what is termed the experience factor. That is, the usual commercial extrusion speed for Alloy 5086 has been about 11 fpm. The experience factor is the commercial speed divided by the maximum speed at the crack onset, or about 33%. Applying this factor to the maximum extrusion speed obtained for the simplex high temperature homogenized billets of 50 fpm gives an effective commercial extrusion speed of about 17 fpm. Therefore, the simplex high temperature homogenization treatment increases the extrusion speed approximately 55% over the usual commercial extrusion speed for the alloys utilized herein.

EXAMPLE III

Samples of the extruded material from Example II were measured for tensile properties in the as-extruded condition. The properties for the extruded material from each homogenization treatment are shown in Table III.

TABLE III

TENSILE PROPERTIES OF AS-EXTRUDED STANDARD AND SIMPLEX HOMOGENIZED BILLETS

| Homogenization | Billet Entry Temp. 20 F | Speed at Sample Location, fpm | YS, ksi | UTS, ksi | Elong. % |
|---|---|---|---|---|---|
| Standard | 875 | 18 | 20.1 | 42.9 | 18 |
| Standard | 880 | 18 | 17.0 | 38.4 | 28 |
| Standard | 880 | 34 | 14.5 | 36.6 | 29 |
| Simplex | 775 | 50 | 14.0 | 38.0 | 25 |
| Simplex | 870 | 50 | 13.9 | 37.4 | 28 |

The results from Table III indicate that as-extruded properties are determined by the extrusion speed, not the particular homogenization treatment used. Equivalent temper properties for slow and fast extrusion speeds can be achieved by increasing the stretch of the lower temper material by about 1%. This is shown in Table IV which compares the standard and simplex homogenized materials at their maximum extrusion speeds (i.e., 34 fpm for standard, 50 fpm for simplex).

TABLE IV

TENSILE PROPERTIES OF STRETCHED STANDARD AND SIMPLEX HOMOGENIZED BILLETS

| Homogenization | % Stretch | YS, ksi | UTS, ksi | Elong. % |
|---|---|---|---|---|
| Standard | 0 | 17.0 | 38.4 | 28 |
| | 1 | 21.3 | 39.1 | 26 |
| | 3 | 27.4 | 39.2 | 22 |
| | 5 | 32.4 | 40.5 | 20 |
| Simplex | 0 | 13.9 | 37.4 | 28 |
| | 1 | 19.0 | 37.8 | 27 |
| | 3 | 25.2 | 38.1 | 24 |
| | 5 | 30.4 | 39.2 | 22 |
| Aluminum Association Minimum Properties | | 21.0 | 36.0 | 12 |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method of heat treating aluminum alloys of the aluminum-magnesium type to improve hot workability which consists essentially of:

a. homogenizing said alloys at a temperature of from 950° to 1050° F for from 2 to 12 hours; and b. cooling said alloys to at least 800° F at a rate of less than 100° F per hour.

2. The method of claim 1 wherein said alloys are cooled to room temperature following said slow cooling step.

3. The method of claim 1 wherein the alloys are reheated to an elevated temperature after being cooled to room temperature and are hot worked at said elevated temperature.

4. The method of claim 3 wherein said alloys are reheated to a temperature of from 800° to 1025° F and held at said temperature prior to hot working.

5. The method of claim 2 wherein the alloys are reheated to an elevated temperature after being cooled to room temperature before being hot worked at said elevated temperature.

6. The method of claim 3 wherein after being hot worked the alloys are cooled and stretched so as to impart desired physical properties to said alloys.

7. The method of claim 1 wherein following said cooling step the alloys are hot worked and subsequently fabricated into articles.

8. The method of claim 2 wherein following said slow cooling step the alloys are hot worked and subsequently fabricated into articles.

9. The method of claim 1 wherein said alloys contain from 0.1 to 1.0% by weight manganese, from 0.05 to 0.35% by weight chromium and from 0.5 to 5.6% by weight magnesium.

10. The method of claim 9 wherein said alloys contain from 3.5 to 5.5% by weight magnesium, from 0.2 to 1.0% by weight manganese, from 0.05 to 0.25% by weight chromium, from 0.001 to 0.5% by weight iron, from 0.001 to 0.4% by weight silicon, from 0.001 to 0.25% by weight zinc, from 0.001 to 0.15% by weight titanium, from 0.01 to 0.1% by weight copper, balance aluminum.

* * * * *